US011371501B2

(12) United States Patent
Metz et al.

(10) Patent No.: US 11,371,501 B2
(45) Date of Patent: Jun. 28, 2022

(54) SCREW SPINDLE PUMP

(71) Applicant: LEISTRITZ PUMPEN GMBH, Nuremberg (DE)

(72) Inventors: Jürgen Metz, Feucht (DE); Florian Popp, Nuremberg (DE); Kristin Lissek, Fürth (DE)

(73) Assignee: LEISTRITZ PUMPEN GMBH, Nuremberg (DE)

( * ) Notice: Subject to any disclaimer, the term of this patent is extended or adjusted under 35 U.S.C. 154(b) by 2 days.

(21) Appl. No.: 17/108,463

(22) Filed: Dec. 1, 2020

(65) Prior Publication Data

US 2021/0164466 A1 Jun. 3, 2021

(30) Foreign Application Priority Data

Dec. 2, 2019 (DE) ..... 10 2019 132 653.2

(51) Int. Cl.
*F01C 1/08* (2006.01)
*F03C 2/00* (2006.01)
(Continued)

(52) U.S. Cl.
CPC ..... *F04C 2/082* (2013.01); *F04C 2/165* (2013.01); *F04C 11/008* (2013.01);
(Continued)

(58) Field of Classification Search
CPC .. F04C 2/082; F04C 2/16; F04C 2/165; F04C 11/008; F04C 15/0042; F04C 15/0073;
(Continued)

(56) References Cited

U.S. PATENT DOCUMENTS 3,097,359 A * 7/1963 Cowles et al. ..... F04C 18/16 418/203
4,934,861 A * 6/1990 Weeks ..... F16B 7/18 403/388
(Continued)

FOREIGN PATENT DOCUMENTS

DE 102014102390 B3 3/2015
DE 102015101443 A 5/2016
(Continued)

OTHER PUBLICATIONS

Japanese Patent Office issued Office Action dated Oct. 19, 2021 regarding parallel Japanese Patent Application, 2 Pages.
(Continued)

*Primary Examiner* — Theresa Trieu
(74) *Attorney, Agent, or Firm* — Lucas & Mercanti, LLP; Klaus P. Stoffel

(57) ABSTRACT

A screw spindle pump for delivering a cooling liquid for cooling a battery and/or power electronics or a cleaning or supply liquid of a motor vehicle, including a housing in which a working spindle, which is coupled to a drive assembly, and at least one running spindle, which meshes with the latter, are accommodated, and including a feather key-like support element, which is fixed by the housing and against which the working spindle and the running spindle are axially supported. In the housing, there is provided at least one aperture through which it is possible to insert the support element, which, in the assembled position, is received with one end in the aperture and with the other end in a receiving part situated diametrically opposite the aperture, wherein the support element is secured via at least one securing element which closes the aperture at the outside.

20 Claims, 2 Drawing Sheets

(51) Int. Cl.

| | |
|---|---|
| ***F03C 4/00*** | (2006.01) |
| ***F04C 18/00*** | (2006.01) |
| ***F04C 2/08*** | (2006.01) |
| ***F04C 11/00*** | (2006.01) |
| ***F04C 2/16*** | (2006.01) |

(52) U.S. Cl.
CPC .. *F04C 2210/1044* (2013.01); *F04C 2230/60* (2013.01); *F04C 2240/30* (2013.01)

(58) Field of Classification Search
CPC ..... F04C 15/0076; F04C 2210/1044; F04C 2230/60; F04C 2240/30; F04C 2240/805; F01C 21/104; F01C 21/108; Y10T 403/7018; Y10T 74/19698
See application file for complete search history.

(56) References Cited

U.S. PATENT DOCUMENTS

| | | | | |
|---|---|---|---|---|
| 6,334,733 | B1 * | 1/2002 | Tyson | F16B 7/182 403/388 |
| 9,765,776 | B2 | 9/2017 | Metz | |
| 2004/0241016 | A1 * | 12/2004 | Beaven | F04C 2/165 417/410.4 |
| 2009/0255515 | A1 * | 10/2009 | Eck | F02M 37/106 123/509 |
| 2016/0222964 | A1 * | 8/2016 | Metz | F04C 2/16 |
| 2019/0017504 | A1 | 1/2019 | Inoue | |
| 2019/0085844 | A1 * | 3/2019 | Trossmann | F04C 15/0046 |
| 2020/0132070 | A1 | 4/2020 | Deichmann | |

FOREIGN PATENT DOCUMENTS

| | | | |
|---|---|---|---|
| DE | 102017210770 | A1 | 12/2018 |
| DE | 102017210771 | A1 | 12/2018 |
| DE | 102018130472 | A1 | 6/2020 |
| EP | 0323834 | A2 | 7/1989 |
| JP | 2011026981 | A | 2/2011 |
| JP | 2016114045 | A | 6/2016 |

OTHER PUBLICATIONS

European Search Report, EP20205416.9 Dated Dec. 7, 2020, 2 Pages.

* cited by examiner

SCREW SPINDLE PUMP

CROSS-REFERENCE TO RELATED APPLICATIONS

The present application claims priority of DE 10 2019 132 653.2, filed Dec. 2, 2019, the priority of this application is hereby claimed, and this application is incorporated herein by reference.

BACKGROUND OF THE INVENTION

The invention relates to a screw spindle pump.

In modern motor vehicles with partially or fully electric drive, use is made of correspondingly large-dimensioned batteries as well as associated power electronics, which require effective cooling since said components produce a large amount of heat during operation. For this purpose, centrifugal pumps are used, in order to deliver the cooling liquid for cooling the battery or the power electronics. A disadvantage, on the one hand, is that such centrifugal pumps have only a relatively low overall efficiency of approximately 40%, which is too low for relatively long-term use in such partially or fully electrically driving motor vehicles, since such centrifugal pumps draw too much current with too low a capacity. Furthermore, such centrifugal pumps, with an average diameter of 70 mm, are also of relatively large-dimensioned and complex construction.

SUMMARY OF THE INVENTION

The invention is therefore based on the problem of specifying a pump which is improved in comparison therewith and which is suitable specifically for use in modern motor vehicles.

To solve this problem, provision is made according to the invention of a screw spindle pump designed for delivering a cooling liquid for cooling a battery and/or power electronics or a drive assembly, in particular of an internal combustion engine or of an electric machine of a motor vehicle, or a cleaning or supply liquid of a motor vehicle, comprising a housing in which a working spindle, which is to be or is coupled to a drive assembly, and at least one running spindle, which meshes with the latter, are accommodated, and comprising a feather key-like support element, which is fixed by the housing and against which the working spindle and the running spindle are axially supported, wherein, in the housing, there is provided at least one aperture through which it is possible to insert the support element, which, in the assembled position, is received with one end in the aperture and with the other end in a receiving part situated diametrically opposite the aperture, wherein the support element is secured via at least one securing element which closes the aperture at the outside.

The invention proposes a screw spindle pump which is designed and dimensioned specifically for delivering a cooling liquid for cooling the battery and/or power electronics or some other cleaning or supply liquid of the motor vehicle, that is to say for example is designed specifically for the delivery of a water-glycol mixture as cooling liquid. Beside a simple construction and the possibility of being able to be configured to be of a very small format, such a screw spindle pump is distinguished in particular by a high overall efficiency of approximately 70%, it therefore working significantly more efficiently than known centrifugal pumps, which is more favorable for the overall energy balance of the motor vehicle via whose battery said screw spindle pump is driven. The fact that the screw spindle pump may be dimensioned to be of a very small format with a simultaneously high efficiency and significantly higher throughput than centrifugal pumps, and that such screw spindle pumps can also be operated at very high rotational speeds of several 1000 rpm, makes it particularly suitable for use in modern motor vehicles, where centrifugal pumps, not least because of their structural size or structural length, have proven to be unsuitable.

By contrast, the screw spindle pump according to the invention is distinguished by the possibility of being designed to be of a very small format, on the one hand, and also by a simple construction, on the other hand. The screw spindle pump has a housing in which the at least two spindles are accommodated, wherein the spindles are axially fixed or supported via a simple feather key-like support element, this meaning that, on the spindle side, no particular precautions have to be taken for the axial support or mounting of the spindles. Said feather key-like support element is fitted at the housing in a very simple manner by being pushed into the housing from the outside through an aperture which is provided in the housing. In the assembled position, the support element is received with the front end in a corresponding receiving part situated diametrically opposite the aperture, the other, rear end being received in the aperture, via which the support element is axially supported, with the result that said support element can perform its support function for the spindles. Simple securing of the support element in the assembled position is realized by a securing element which is provided at the housing and which closes the aperture.

The aperture or the support element is expediently provided in a cylindrical housing portion, whereby the mounting of the securing element, which has a corresponding cylindrical over-engagement portion, is configured in a particularly simple manner too.

Altogether, the invention accordingly proposes a simply constructed screw spindle pump which is able to be of very small dimensions and which exhibits very good smoothness of running, consequently therefore working very quietly, and which can be operated at extremely high rotational speeds of several 1000 rpm. Said screw spindle pump has, almost constantly, a high overall efficiency of up to approximately 70% over the high rotational speed range, and is distinguished by a flat efficiency curve with respect to the rotational speed. Such a screw spindle pump may therefore advantageously be used in particular in modern motor vehicles, be it motor vehicles with partially or fully electric drive, or else motor vehicles with conventional internal combustion engines, or motor vehicles with alternative drive concepts, since said screw spindle pump can be designed to be of a very small format but at the same time has a very high overall efficiency, and accordingly low current consumption, and accordingly is also able to be integrated into complex systems with a small installation space.

As described, the front end, pushed through the aperture first of all, of the feather key-like support element is fixed in a corresponding opposite receiving part. Said receiving part may be a simple depression into which the feather key end engages. It is however also conceivable for two apertures situated diametrically opposite one another to be provided, wherein the support element is received with its two ends in the apertures and is secured via the securing element closing the two apertures at the outside. A symmetrical configuration is therefore provided here by the formation of two apertures situated diametrically opposite one another, this being particularly simple from a manufacturing aspect. The feather key-like support element can be very easily pushed in from both sides during the assembly, after which only the securing element, which secures the support element with respect to the two apertures, still has to be placed.

For a configuration which is as simple as possible, the housing has an externally cylindrical portion in which the one or the two apertures are provided, on which cylindrical portion the securing element is or is able to be arranged. The cylindrical shape, both as far as the housing and the securing element are concerned, is able to be formed in a simple manner during the production, and also the attachment of the securing element on the cylindrical portion is very simple since it merely has to be pushed on and, in the process, then automatically engages over the corresponding apertures.

A particularly advantageous refinement of the invention provides that the housing is of two-part form and has a first housing part, in which the working spindle and the at least one running spindle are accommodated, and a second housing part, which is or is able to be arranged detachably on the first housing part and which has a connection portion for a cooling medium feed line. The housing of the screw spindle pump according to the invention accordingly has two parts, with a first housing part and a second housing part, wherein the first housing part is the actual central housing part in which the spindle and also the support element are provided. The second housing part, which is or can be arranged detachably on the first housing part, has, by contrast, a connection portion for a cooling medium feed line. This embodiment firstly makes it possible for the central first housing part to be designed in a more or less standardized manner since it is identical for all pumps. By contrast, it is possible for the second housing part to be designed, if appropriate, in a user-individual manner, in particular as far as the dimensioning or type, shape, size and orientation of the connection portion for the cooling medium feed line is/are concerned. Even if said second housing part is also designed in a manner standardized and identical for all types, this two-part embodiment is expedient, in particular in terms of production, since the two housing parts may be designed in a correspondingly simple manner, and merely have to be connected to one another so as to obtain an overall housing which contains or has all the relevant components.

Here, a particularly advantageous refinement of this variant of the invention provides that the second housing part is at the same time the securing element. This means that the second housing part has a dual function, specifically, on the one hand, providing the connection portion for a cooling medium feed line, consequently therefore forming the suction-side connection, and, on the other hand, simultaneously however also providing the securing function for the feather key-type support element. For this purpose, the second housing part has a corresponding securing portion, by way of which the second housing part is pushed onto the first housing part, in a manner engaging in the process over the portion in which the one or the two apertures in which the feather key ends are received. The assembly is conceivably simple, since, after placement of the feather key, it is merely necessary for the second housing part to be pushed on and to be correspondingly fixed, after which the assembly is finally complete.

As an alternative to the configuration according to which the second housing part is simultaneously also the securing element, it is conceivable for use to be made, as a securing element, of a collar ring which is attached to the housing, and to provide a separate connection piece component which is or is able to be arranged detachably on the housing. The collar ring, for example a screw ring, may be placed onto a corresponding retaining portion on the housing and fixed there, for example screwed on, such that, in this way, the corresponding fixing of the feather key is provided. Additionally, in this configuration, a connection piece component is then to be fixed to the housing, which can be realized for example also by screw connection. Whereas, here, the screw spindle has three components, that is to say a housing, a separate securing element and a separate connection piece component, the above-described first alternative of the invention, in which the second housing part is, as it were, multi-functional and not only provides the connection piece but also serves as the securing element, is distinguished by a particularly small number of parts.

In both variants, however, it is necessary to detachably fix to one another the two housing parts or the housing and the collar ring. At least one fixing element is expediently used for this purpose, wherein such a fixing element can vary in its nature as long as it connects the corresponding elements sufficiently firmly to one another, that is to say secures or fixes them in particular axially with respect to one another. It is alternatively also possible for screw connection of the two housing parts or of two or all of the components of the collar ring configuration to be realized, for the purpose of which corresponding threaded portions are provided on the components.

In one refinement of the invention, such a fixing element may be a clamp or clip that engages into recesses and/or grooves in both housing parts or in the housing and the collar ring. Very simple mechanical fixing therefore takes place using the clamp or clip, because the clamp or clip is merely to be inserted into the corresponding recesses/grooves, via which the parts are automatically fixed to one another.

For simple fixing or arrangement of the clamp or clip, it is conceivable to provide, in the second housing part or in the collar ring, one or more slot-like first recesses which has/have associated therewith one or more second, groove-like recesses in the first housing part or in the housing, wherein, in the assembled position, the clamp or clip that is to be fixed on the second housing part or on the collar ring engages through the one or more first, slot-like recesses and engages into the one or more groove-like second recesses. Here, two first and second recesses situated diametrically opposite one another are preferably provided, so that the fixing is possible in a secure and symmetrical manner at two positions situated opposite one another.

During the assembly, it is merely necessary for the clamp or clip, which is a U-shaped component, to be pushed more or less from the side onto the second housing component or the collar ring, and thus to be pushed into the elongate slot-like recesses, wherein, with the end position reached, the clamp or clip, or the arms thereof, automatically engages/engage through the slot-like recesses and engages/engage or snaps/snap into the second groove-like recesses situated therebelow. Said clamp or clip is therefore fixed both to the first and to the second housing part or to the collar ring and to the housing, with the result that secure axial fixing is provided. Groove-like recesses in the first housing part or in the housing are to be understood as being recesses which are delimited on both sides via corresponding groove limbs, and also a fold-type recess.

In one refinement of the invention, it is conceivable to provide a support ring against which the second housing part or the collar ring bears and via which the second housing part or the collar ring is supported radially against the first housing part or against the housing. The support ring has for example a conical abutment surface, by way of which it is supported against a conical support surface on the first housing part or on the housing.

Furthermore, there is expediently provided at least one sealing element which provides sealing between the first and the second housing part or the collar ring and the housing, for example a simple sealing ring composed of rubber or some other elastomer or the like. The fluid-tight sealing of the two-part housing or of the collar ring with respect to the housing is realized via said sealing element, with the result that any fluid leakage in this region is ruled out.

In this case, in the inner circumference of the second housing part or of the collar ring, and/or in the outer circumference of the first housing part or of the housing, there is expediently provided an encircling groove or a collar, in which the sealing element, in the form of a sealing ring, is received. The groove or the collar and also the sealing ring are of course dimensioned in such a way that secure, fluid-tight abutment or sealing is ensured.

As already described, the screw spindle pump according to the invention basically offers the possibility of being designed to be of a very small format, consequently therefore of being constructed to be, as seen axially, very short and also, radially, very slender. In a more specific refinement, it may be provided for this purpose that those portions of the drive spindle and of the at least one running spindle which mesh with one another have a length of at most 4 cm, in particular of at most 3 cm and at least of 1 cm, in particular at least of 2 cm. This means that the spindle lengths are in the region of only a few centimeters, with the result that the overall length of the housing, be it for a two-part housing, be it for a one-part housing, ultimately including the connection piece configuration irrespective of how this is specifically formed, is also likewise in the region of a few centimeters. The connection piece portion itself projects only a few centimeters from the actual spindle housing region, and so its length is in the region of the spindle length. This means that such a screw spindle pump has an overall length for example of at most 8 cm, but also significantly below this for spindles shorter than 4 cm.

In order that the spindle is also as compact as possible radially, it is expedient for those portions of the working spindle and of the at least one running spindle which mesh with one another to have an outer diameter of at most 1 cm and at least 0.5 cm. This means that, according to the invention, extremely slender spindles are also used, which of course has an advantageous effect on the outer diameter of the housing.

As described, the housing, irrespective of how it is then specifically designed, is to be coupled to a drive assembly, normally to a likewise highly compact electric motor. For this purpose, on the drive-side end of the drive spindle, there is expediently provided a connection geometry at which a coupling element coupled or able to be coupled to the drive assembly is connected in a rotationally conjoint manner. Such a mechanical coupling is known for example from DE 10 2015 101 443 A1 and may also be provided with the screw spindle pump according to the invention. The coupling element offers a standardized interface to which the drive spindle can be connected at one side, and the drive shaft of the drive assembly can be connected at the other side, when the housing of the pump is connected, normally screwed, to the housing of the drive assembly.

An advantageous refinement of the invention provides for manufacturing the housing, that is to say the first and second housing parts in the case of the two-part configuration, or the housing and the collar ring, etc, and likewise also the connection piece, if one is separately provided, from plastic. This means that the entire housing of the screw spindle pump according to the invention is composed of plastic, consequently therefore being very light and being able to be produced in a suitable plastic injection-molding process. Only the spindles are composed of metal, this correspondingly also applying to the clamp or clip, if provided. The coupling element may also be composed of metal, but of plastic too.

Beside the screw spindle pump itself, the invention furthermore relates to the use of a screw spindle pump, in particular a screw spindle pump of the above-described type, in a motor vehicle for delivering a cooling or cleaning or supply liquid.

In particular, the screw spindle pump is used for delivering a cooling liquid for cooling a battery or power electronics or a drive assembly, such as of an internal combustion engine or of an electric machine of the motor vehicle, wherein a water-glycol mixture is preferably used as cooling liquid.

The invention furthermore relates to a motor vehicle comprising at least one screw spindle pump of the above-described type. It goes without saying that it is also possible for there to be provided in the motor vehicle multiple such screw spindle pumps according to the invention, which are associated with different assemblies and serve for delivering cooling, cleaning or supply liquid. For example, a first screw spindle pump may serve for delivering the cooling liquid to the battery(ies) or to the power electronics of the vehicle, while a second screw spindle pump serves for example for delivering a cleaning liquid which is sprayed for high-pressure cleaning of cameras or sensor systems of vehicles, in particular partially or fully autonomously driving vehicles, and the like.

The various features of novelty which characterize the invention are pointed out with particularity in the claims annexed to and forming a part of the disclosure. For a better understanding of the invention, its operating advantages, specific objects attained by its use, reference should be had to the drawings and descriptive matter in which there are illustrated and described preferred embodiments of the invention.

DETAILED DESCRIPTION OF THE INVENTION

Figure 1:
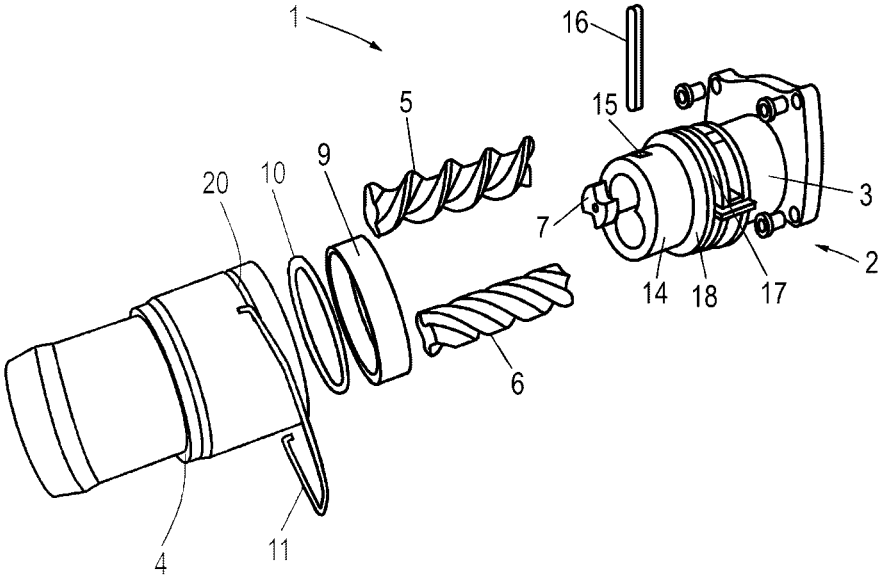
FIG. 1 shows an exploded illustration of a screw spindle pump according to the invention of a first embodiment.

FIG. 1 shows, in the form of a basic illustration, a screw spindle pump 1 according to the invention, which is designed for delivering a cooling liquid for cooling a battery and/or power electronics or a cleaning or supply liquid of a motor vehicle. Said pump consists of a housing 2 having a first housing part 3 and having a second housing part 4, which are able to be fastened detachably to one another.

Also provided is a working spindle 5 and a running spindle 6, which, in the assembled position (see FIG. 2), interengage and mesh with one another. A coupling element 7 is able to be attached to the working spindle 5 at a corresponding connection geometry, via which coupling element a connection to a drive assembly (not shown in any more detail) in the form of an electric motor can be realized. Also provided is a support ring 9, which serves for radially supporting the second housing part 4, and a sealing element 10 in the form of a sealing ring, which serves for sealing off the two housing parts 3, 4 with respect to one another in a fluid-tight manner, as well as a fixing element 11 in the form of a clamp or clip, via which the two housing parts 3, 4 are fixed to one another.

Figure 2:
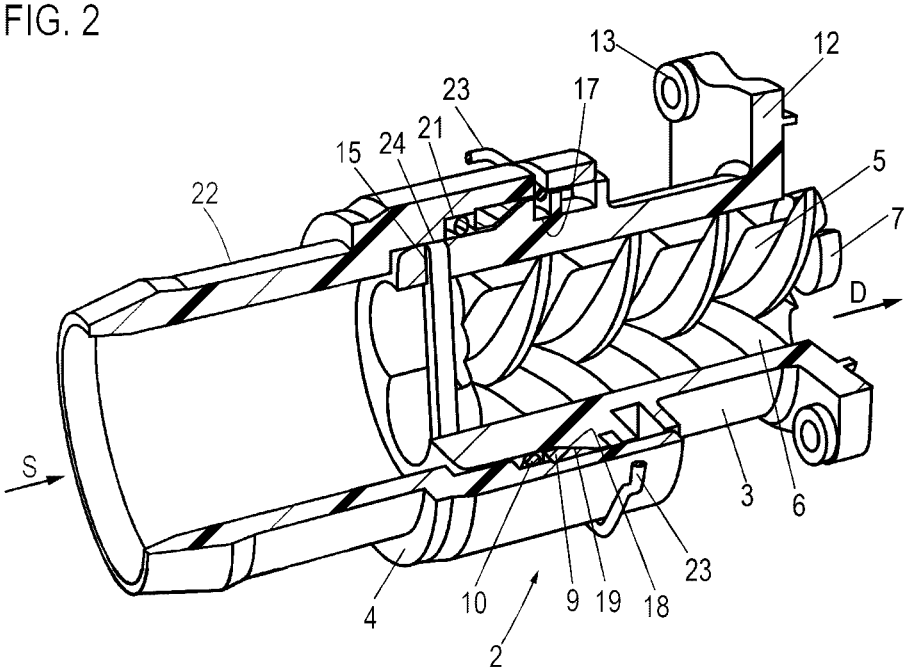
FIG. 2 shows, in a 90° sectional view, the screw spindle pump from FIG. 1 in the assembled state.

The view as per FIG. 2 shows the assembled position. Firstly, it is possible to see the first housing part 3, which has an end-side fastening flange 12 via which it is connected to the housing of the drive assembly via suitable screw connections comprising bushes 13 into which corresponding connecting screws are screwed. As FIG. 2 shows, the first housing part is open in the region of the fastening flange 12 as viewed axially, with the result that the ends of the two spindles 5, 6 are exposed and a coupling to the drive assembly via the coupling element 7 is readily possible, and also that the fluid sucked in from the suction side (shown by the arrow S) can be delivered via this pressure side (identified by the arrow D).

The first housing part 3 furthermore has an elongate cylindrical portion 14, in which, in the example shown, two apertures 15, of which only one is shown in the figures, are formed, said apertures serving for receiving a feather key-like support element 16. Said support element (see FIG. 2) is, more or less, introduced from the outside into the first aperture 15 and, with the leading end, is inserted into the opposite, second aperture, which acts as a receiving part, while the other end is received in the first aperture. Said feather key-like support element serves for axially supporting the two spindles 5, 6.

A groove-like receiving part 17 is furthermore provided in the outer side of the first housing part and, as will be discussed further below, serves for receiving the fixing element 11, via which the second housing part 4 is fixed to the first housing part 3. Furthermore, there is provided on the outer side of the first housing part 3 a conical support portion 18 against which the support ring 9 bears with a conical abutment surface 19, as FIG. 2 shows.

FIGS. 1 and 2 furthermore show corresponding details of the second housing part 4 too. This has two slot-like recesses 20 which are situated diametrically opposite one another and which extend more or less transversely with respect to the longitudinal axis of the second housing part 4. In the assembled position, said recesses are situated directly adjacently to the in this case encircling groove-like recess 17 such that they can each receive a limb of the fixing element 11 that engages into the slot-like recess 20, on the one hand, and also into the groove-like recess 17, on the other hand, with the result that axial securing is provided.

Also provided, in the inner circumference of the second housing part 4, is an encircling groove or collar 21, in which the sealing element 10, in the form of a sealing ring, is received.

Finally, at the free end of the second housing part 4, there is provided a corresponding connection portion 22 for the fastening of a fluid feed line via which the sucked-in fluid is fed.

During the assembly, first of all the two spindles 5, 6 are inserted together with the coupling element 7, provided that it is not also the case that this is only possible at a later stage. At any rate, the feather key-like support element 16 is pushed into the two apertures 15, whereupon there is pushed onto the first housing part 3 the support ring 9, followed by the sealing ring 10, after which the second housing part 4 is pushed onto the first housing part 3. Said second housing part is pushed to such an extent that the slot-like recesses 20 are in radial overlap with one or the two groove-like recesses 17, after which the clamp- or clip-like fixing element 11 is pushed on from the side such that in each case an arm 23 engages into the respective slot-like recess 20 and the groove-like recess 17, via which both housing parts are axially fixed with respect to one another. In the assembled position, the fixing element is anchored firmly to the housing 2. It can, if at all, be released from the clamping or snap fit only with a corresponding expenditure of force. The second housing part 4 is supported radially against the support ring 9. At the same time, the second housing part 4 also engages radially with a collar 24, running adjacently to the collar 21, over the two apertures 15, with the result that the feather key-like support element 16 is secured in this way.

This means that the second housing part 4 is assigned a dual function. On the one hand, it serves as a securing element for fixing the feather key-like support element 16 in a position, and on the other hand, it also however provides the corresponding connection portion 22.

The two housing parts 3, 4 are, like the support ring too, manufactured from plastic, and the sealing element 10 is a plastic or elastomer ring. Only the two spindles 5, 6 and the coupling element 7, the feather key-like support element 16 and the fixing element 11 are composed of metal.

The construction is very simple, which has an advantageous effect on the production costs. It is also the case that the screw spindle pump 1 has very small dimensions, because the length of the spindles 5, 6 or their interengaging portions is in the region of only a few centimeters, these preferably being at most 4 cm long, preferably even slightly shorter, with a diameter of approximately 0.5-1 cm, so that a small construction which is highly compact both axially and radially is obtained. Since the second housing part 4 engages over approximately half of its length over the first housing part 3 and only the connection portion 22 continues to project, a very short structural length, as viewed axially, of the screw spindle pump with all the constituent parts is accordingly also obtained.

Figure 3:
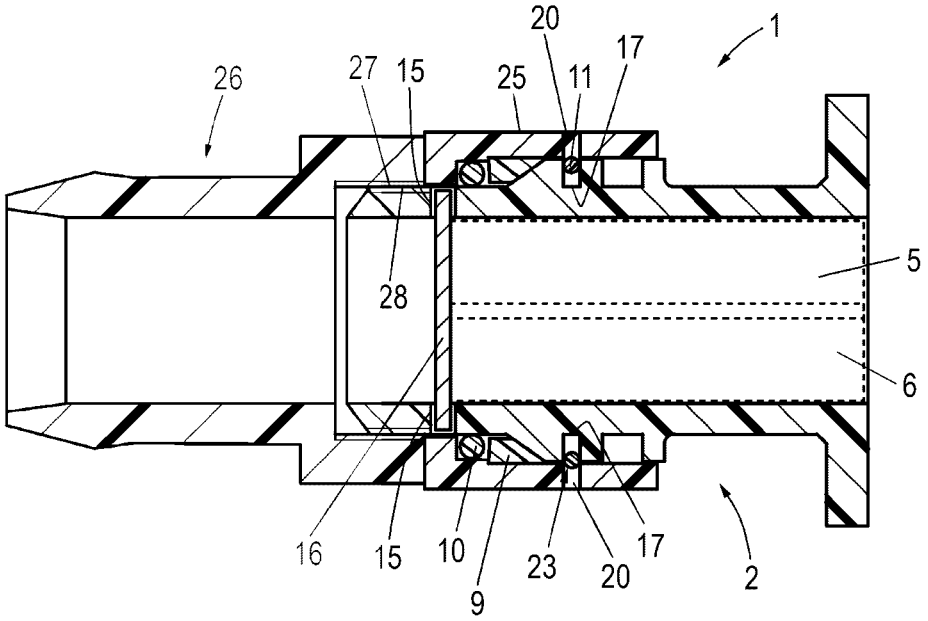
FIG. 3 shows a sectioned basic illustration of a screw spindle pump according to the invention of a second embodiment.

FIG. 3 shows a basic illustration of a screw spindle pump 1 according to the invention, wherein the same reference signs are used for identical components. Here too, provision is made of a housing 2, this however being of one-part design. The working spindle 5 and the running spindle 6, which are indicated here merely in outline, are again accommodated, and axially supported via the feather key-like support element 16, in said housing. Said feather key-like support element is again fixed to the housing 2 with its two ends in two apertures 15 in the same manner as described above.

For the fixing of the support element 16, use is made here of a collar ring 25, which is fixed via the clamp-like fixing element 11 in the same way as the second housing part 4 as per FIGS. 1 and 2. For this purpose, the collar ring 25 likewise has two slot-like recesses 20, and also the housing 2 has one or two groove-like recesses 17, into which the corresponding arms 23 of the clamp-like fixing element 11 engage. This means that the axial fixing is realized in the same manner as that of the second housing part as per FIG. 1. Alternatively, the collar ring 25 could also be screwed on.

A corresponding support ring 9 and the sealing element 10, which serve for support and sealing, are again provided.

Also provided is a separate connection piece component 26, which has an inner thread portion 27 which is screwed onto an outer thread portion 28 of the housing 2. For example, the connection piece component 26 is screwed against the collar ring 25, so that the latter is additionally axially fixed, and also of course a corresponding space may be provided here, and possibly an additional sealing element or the like may also be provided between the collar ring 25 and the connection piece component 26.

While specific embodiments of the invention have been shown and described in detail to illustrate the inventive principles, it will be understood that the invention may be embodied otherwise without departing from such principles.

We claim:

1. A screw spindle pump designed for delivering a cooling liquid for cooling a battery and/or power electronics or a drive assembly of a motor vehicle or a cleaning or supply liquid of a motor vehicle, comprising a housing in which a working spindle, which is couplable to a drive assembly, and at least one running spindle, which meshes with the latter, are accommodated, and comprising a feather key-like support element, which is fixed by the housing and against which the working spindle and the running spindle are axially supported, wherein, in the housing, there is provided at least one aperture through which it is possible to insert the feather key-like support element, which, in the assembled position, is received with one end in the aperture and with the other end in a receiving part situated diametrically opposite the aperture, wherein the feather key-like support element is secured via at least one securing element which closes the aperture externally.

2. The screw spindle pump according to claim 1, wherein two apertures situated diametrically opposite one another are provided, wherein the feather key-like support element is received with its two ends in the apertures and is secured via the securing element closing the two apertures externally.

3. The screw spindle pump according to claim 1, wherein the housing has an externally cylindrical portion in which the one or the two apertures are provided, on which cylindrical portion the securing element is arranged.

4. The screw spindle pump according to claim 1, wherein the housing is of two-part form and has a first housing part, in which the working spindle and the at least one running spindle are accommodated, and a second housing part, which is arranged detachably on the first housing part and which has a connection portion for a cooling medium feed line.

5. The screw spindle pump according to claim 4, wherein the second housing part is at the same time the securing element.

6. The screw spindle pump according to claim 4, wherein the securing element is a collar ring, and in that there is provided a separate connection piece component which is arranged detachably on the housing.

7. The screw spindle pump according to claim 6, wherein both housing parts or the housing and the collar ring are connected detachably to one another via at least one fixing element or a screw connection.

8. The screw spindle pump according to claim 7, wherein the fixing element is a clamp or clip that engages into at least one of recesses or grooves in both housing parts or in the housing and the collar ring.

9. The screw spindle pump according to claim 8, wherein, in the second housing part or in the collar ring, there are provided one or more slot-like first recesses which has/have associated therewith one or more second, groove-like recesses in the first housing part or in the housing, wherein, in the assembled position, the clamp or clip that is to be fixed on the second housing part or on the collar ring engages through the one or more, slot-like first recesses and engages into the one or more second, groove-like recesses.

10. The screw spindle according to claim 9, wherein two first or second recesses situated diametrically opposite one another are provided.

11. The screw spindle pump according to claim 6, wherein there is provided a support ring against which the second housing part or the collar ring bears and said second housing part or collar ring is supported radially against the first housing part or against the housing.

12. The screw spindle pump according to claim 11, wherein the support ring has a conical abutment surface, by way of which it is supported against a conical support surface on the first housing part or on the housing.

13. The screw spindle pump according to claim 6, comprising at least one sealing element which provides sealing between the first and the second housing parts or the collar ring and the housing.

14. The screw spindle pump according to claim 13, wherein, in an inner circumference of the second housing part or of the collar ring, or in an outer circumference of the first housing part or of the housing, there is provided an encircling groove or collar, in which the sealing element, in the form of a sealing ring, is received.

15. The screw spindle pump according to claim 1, wherein portions of the working spindle and of the at least one running spindle mesh with one another and have a length of at most 4 cm.

16. The screw spindle pump according to claim 15, wherein the portions of the working spindle and of the at least one running spindle that mesh with one another have a length of at most 3 cm and at least of 1 cm.

17. The screw spindle pump according to claim 16, wherein the portions of the working spindle and of the at least one running spindle that mesh with one another have a length of at least 2 cm.

18. The screw spindle pump according to claim 1, wherein portions of the working spindle and of the at least one running spindle mesh with one another and have an outer diameter of at most 1 cm and at least 0.5 cm.

19. The screw spindle pump according to claim 1, wherein, on the drive-side end of the working spindle, there is provided a connection geometry at which a coupling element coupled to the drive assembly is connected in a rotationally conjoint manner.

20. The screw spindle pump according to claim 1, wherein the housing is composed of plastic.

* * * * *